US008739773B2

(12) United States Patent
Ambrose et al.

(10) Patent No.: US 8,739,773 B2
(45) Date of Patent: Jun. 3, 2014

(54) OVEN RACK HAVING INTEGRAL LUBRICIOUS, DRY PORCELAIN SURFACE

(75) Inventors: Jeffrey A. Ambrose, Evansville, IN (US); Gail Mackiewicz-Ludtka, Oak Ridge, TN (US); Vinod K. Sikka, Oak Ridge, TN (US); Jun Qu, Knoxville, TN (US)

(73) Assignee: SSW Holding Company, Inc., Fort Smith, AR (US)

( * ) Notice: Subject to any disclaimer, the term of this patent is extended or adjusted under 35 U.S.C. 154(b) by 1170 days.

(21) Appl. No.: 12/301,718

(22) PCT Filed: May 24, 2007

(86) PCT No.: PCT/US2007/012398

§ 371 (c)(1),
(2), (4) Date: Nov. 25, 2009

(87) PCT Pub. No.: WO2008/013596

PCT Pub. Date: Jan. 31, 2008

(65) Prior Publication Data

US 2010/0059041 A1 Mar. 11, 2010

Related U.S. Application Data

(63) Continuation-in-part of application No. 11/440,992, filed on May 25, 2006, now abandoned.

(51) Int. Cl.
*F24C 15/16* (2006.01)

(52) U.S. Cl.
USPC ..... 126/337 R; 126/339; 427/201; 428/402

(58) Field of Classification Search
USPC ..... 126/338, 339, 333, 337 R; 427/458, 427/475, 201; 312/410; 428/402
See application file for complete search history.

(56) References Cited

U.S. PATENT DOCUMENTS 1,896,307 A * 2/1933 Hatch ..... 312/408
2,633,400 A * 3/1953 Ring ..... 312/410

(Continued)

FOREIGN PATENT DOCUMENTS

CA 2 422 158 A1 9/2003
EP 0 201 179 A2 12/1986

(Continued)

OTHER PUBLICATIONS

International Preliminary Report on Patentability for Application No. PCT/US2007/012398, dated Jun. 1, 2010.

(Continued)

*Primary Examiner* — Kenneth Rinehart
*Assistant Examiner* — Bao D Nguyen
(74) *Attorney, Agent, or Firm* — Marshall, Gerstein & Borun LLP

(57) ABSTRACT

A lubricious glass-coated metal cooking article capable of withstanding repeated heating and cooling between room temperature and at least 500° F. without chipping or cracking the glass coating, wherein the glass coating includes about 0.1 to about 20% by weight of a homogeneously distributed dry refractory lubricant material having a particle size less than about 200 μm. The lubricant material is selected from the group consisting of carbon; graphite; boron nitride; cubic boron nitride; molybdenum (FV) sulfide; molybdenum sulfide; molybdenum (IV) selenide; molybdenum selenide, tungsten (IV) sulfide; tungsten disulfide; tungsten sulfide; silicon nitride ($Si_3N_4$); TiN; TiC; TiCN; $TiO_2$; TiAlN; CrN; SiC; diamond-like carbon; tungsten carbide (WC); zirconium oxide ($ZrO_2$); zirconium oxide and 0.1 to 40 weight % aluminum oxide; alumina-zirconia; antimony; antimony oxide; antimony trioxide; and mixtures thereof.

59 Claims, 7 Drawing Sheets

(56) References Cited

U.S. PATENT DOCUMENTS

| | | | | | |
|---|---|---|---|---|---|
| 3,266,477 | A * | 8/1966 | Stiles | 126/19 R |
| 3,761,293 | A * | 9/1973 | Carini et al. | 501/16 |
| 3,862,880 | A * | 1/1975 | Feldman | 428/319.9 |
| 3,928,083 | A * | 12/1975 | Gondo et al. | 148/546 |
| 3,939,013 | A * | 2/1976 | Gardner et al. | 148/629 |
| 3,994,814 | A * | 11/1976 | Cairns | 508/104 |
| 4,161,415 | A * | 7/1979 | Van den Sype et al. | 148/578 |
| 4,194,495 | A * | 3/1980 | Scherer | 126/339 |
| 4,465,799 | A * | 8/1984 | Platkiewicz et al. | 523/457 |
| 4,628,004 | A * | 12/1986 | Nickola et al. | 428/413 |
| RE32,464 | E * | 7/1987 | Aine | 428/622 |
| 4,871,266 | A * | 10/1989 | Oda | 384/42 |
| 4,934,837 | A * | 6/1990 | Kawamura | 384/463 |
| 5,108,813 | A * | 4/1992 | Noda et al. | 428/141 |
| 5,160,761 | A * | 11/1992 | Koga et al. | 427/548 |
| 5,190,450 | A * | 3/1993 | Ghosh et al. | 418/189 |
| 5,382,552 | A * | 1/1995 | Saad et al. | 501/25 |
| 5,409,165 | A * | 4/1995 | Carroll et al. | 239/88 |
| 5,413,877 | A * | 5/1995 | Griffith | 428/698 |
| 5,651,597 | A * | 7/1997 | Oslin | 312/350 |
| 5,722,803 | A * | 3/1998 | Battaglia et al. | 407/119 |
| 5,739,485 | A * | 4/1998 | Cholet et al. | 181/282 |
| 5,759,297 | A * | 6/1998 | Teracher et al. | 148/320 |
| 5,802,955 | A * | 9/1998 | Stoll et al. | 92/248 |
| 5,870,946 | A * | 2/1999 | Dudley | 99/426 |
| 6,004,894 | A * | 12/1999 | Faust et al. | 501/17 |
| 6,007,922 | A * | 12/1999 | Sue et al. | 428/561 |
| 6,010,248 | A * | 1/2000 | Ueno et al. | 384/527 |
| 6,067,981 | A * | 5/2000 | Peter et al. | 126/337 R |
| 6,096,436 | A * | 8/2000 | Inspektor | 428/469 |
| 6,149,073 | A * | 11/2000 | Hickey et al. | 239/89 |
| 6,177,201 | B1 * | 1/2001 | Wallace et al. | 428/472 |
| 6,189,527 | B1 * | 2/2001 | Walsh et al. | 126/25 R |
| 6,228,483 | B1 * | 5/2001 | Sarin | 428/336 |
| 6,248,434 | B1 * | 6/2001 | Rodiger et al. | 428/307.7 |
| 6,303,183 | B1 * | 10/2001 | Wilczynski et al. | 427/193 |
| 6,325,899 | B1 * | 12/2001 | DeWent | 204/164 |
| 6,387,132 | B1 * | 5/2002 | Deppisch et al. | 623/22.11 |
| 6,447,667 | B1 * | 9/2002 | Bates et al. | 205/384 |
| 6,475,939 | B1 * | 11/2002 | Souchard et al. | 501/14 |
| 6,558,616 | B2 * | 5/2003 | Ito et al. | 419/7 |
| 6,579,833 | B1 * | 6/2003 | McNallan et al. | 508/100 |
| 6,610,229 | B1 * | 8/2003 | Morales et al. | 264/123 |
| 6,627,313 | B2 * | 9/2003 | Okinaka et al. | 428/402 |
| 6,828,041 | B2 * | 12/2004 | Ueda et al. | 428/660 |
| 6,837,235 | B2 * | 1/2005 | Blankenship | 126/337 R |
| 6,915,552 | B2 * | 7/2005 | Blankenship | 29/460 |
| 6,932,862 | B2 * | 8/2005 | Daugherty | 106/287.14 |
| 7,087,862 | B1 * | 8/2006 | Shaffer et al. | 219/392 |
| 2001/0002000 | A1 * | 5/2001 | Kumar et al. | 204/192.1 |
| 2002/0011919 | A1 * | 1/2002 | Ito et al. | 338/23 |
| 2002/0189722 | A1 * | 12/2002 | Hasz et al. | 148/528 |
| 2003/0099775 | A1 * | 5/2003 | Daugherty | 427/376.2 |
| 2004/0155387 | A1 * | 8/2004 | Fivas | 264/640 |
| 2004/0201175 | A1 * | 10/2004 | Buchmann et al. | 277/358 |
| 2004/0240991 | A1 * | 12/2004 | Bruce | 415/160 |
| 2005/0252446 | A1 * | 11/2005 | Hoshino et al. | 118/500 |
| 2006/0059688 | A1 * | 3/2006 | Tseng et al. | 29/898.02 |
| 2006/0089270 | A1 * | 4/2006 | Vose | 508/113 |
| 2006/0198959 | A1 * | 9/2006 | Murata et al. | 427/256 |
| 2007/0272231 | A1 * | 11/2007 | Ambrose | 126/337 R |
| 2010/0059041 | A1 * | 3/2010 | Ambrose et al. | 126/337 R |

FOREIGN PATENT DOCUMENTS

| | | | |
|---|---|---|---|
| EP | 1 535 680 | A | 6/2005 |
| EP | 1 548 153 | A2 | 6/2005 |
| GB | 2 171 580 | A | 8/1986 |
| JP | 62-272029 | A | 11/1987 |
| WO | WO-00/56537 | A1 | 9/2000 |
| WO | WO-03/078900 | A1 | 9/2003 |
| WO | WO-2004/094341 | A1 | 11/2004 |

OTHER PUBLICATIONS

International Search Report and Written Opinion for Application No. PCT/US2007/012398, dated May 21, 2010.

Affidavit of Roderick I. L. Guthrie in the Matter of Canadian Patent Application No. 2,422,158.

Flow Chart, Porcelian Enamel Manufacturing Process, published by the Porcelain Enamel Institute, on or before Mar. 1, 2001.

Hydrogen Degradation of Ferrous Alloys, Ed. Oriani et al., Noyes Publications, 1985.

Manual for Preparation of Sheet Steel for Porcelain Enameling, PEI-301, published by the Porcelain Enamel Institute, on or before Mar. 1, 2001.

Manual for Selection of Porcelain Enameling Steels, PEI-201,published by the Porcelain Enamel Institute, on or before Mar. 1, 2001.

Manual of Drying and Firing Porcelain Enamel, PEI-601, published by the Porcelain Enamel Institute, on or before Mar. 1, 2001.

Manual of Electrostatic Porcelain Enamel Powder Application, Porcelain Enamel Institute Technical Manual No. PEI-501, published on or before Mar. 1, 2001.

Manual of Tests, Measurements and Process Controls, PEI-1101, Copyright 1996-1997 Porcelain Enamel Institute.

Porcelain Enameling, "Dip, Barrier, and Chemical Conversion Coatings", Tool Manufacturing Engineers Handbook, Society of Manufacturing Engineers, published on or before Mar. 1, 2001; pp. 454-468.

Protest Under Section 10 of the Canadian Patent Rules, as filed Dec. 7, 2005, in the Matter of Canadian Patent Application No. 2,422,158, as Filed Mar. 14, 2003, as Submitted to the Commisisoner of Patent, Canadian Intellectual Property Office from Ogilvy Renault LLP/S.E.N.C.R.L., s.r.l.

S-100 Manual of Architectural Porcelain Enamel, PEI-1001, Copyright 1996-1997 Porcelain Enamel Institute.

Standard Specification for Steel, Sheet, Carbon, and High-Strength, Low-Alloy, Hot-Rolled and Cold-Rolled, General Requirements for; ASTM Bulletin No. A 568/A 568M-95, American Society for Testing and Materials, published 1995; pp. 256-264.

Standard Specification for Steel, Sheet, for Porcelain Enameling, ASTM Bulletin No. A 424-92, American Society for Testing and Materials, published 1992; pp. 169-170.

Technical Guide for Porcelain Enamel Powder Application, published by the Porcelain Enamel Institute, on or before Mar. 1, 2001.

The Book of Steel, Ed. G. Beranger et al., 1996, published by the steel producer Sollac, Chapter 48 "Enameling Steel".

United States Steel "Making, Shaping and Treating of Steel", Ninth Edition, edited by Harold E. McGannon.

What is Steel?, unattributable source, published on or before Mar. 1, 2001, pp. 1-17.

Partial International Search Report for Application No. PCT/US2007/012398, dated Mar. 12, 2009.

* cited by examiner

12"
10"

20"
22"
15"
12"

14"
20"

9
9
16"
12"
10"

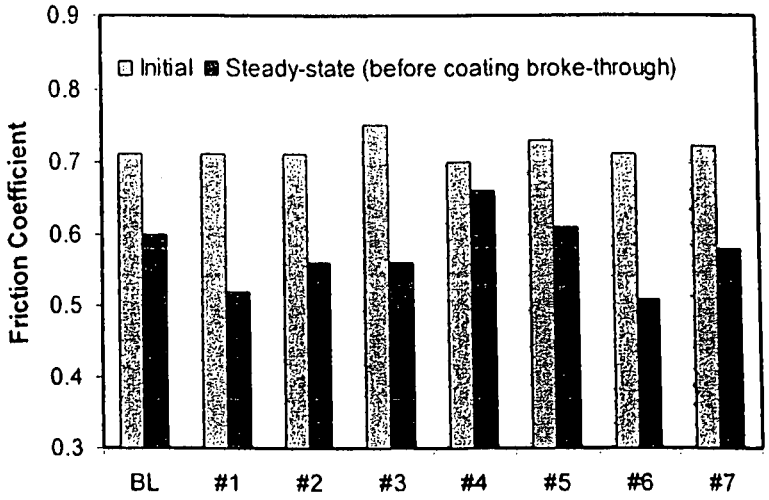
Fig. 13A Friction behavior (50 N, 1000 cycles)
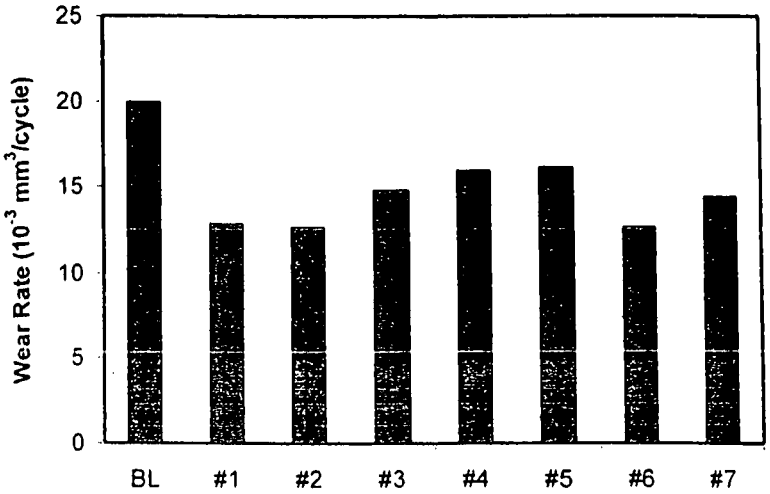
Fig. 13B Friction behavior (50 N, 1000 cycles)

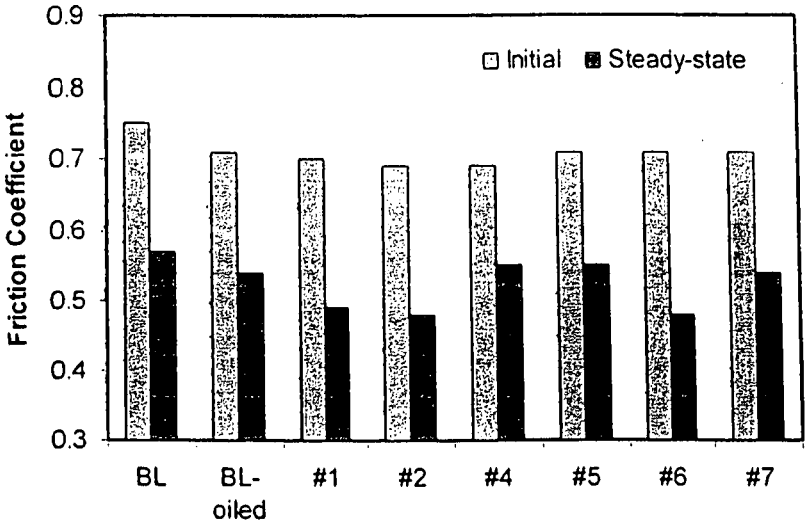
Fig. 14A Friction behavior (13 N, 600 cycles)
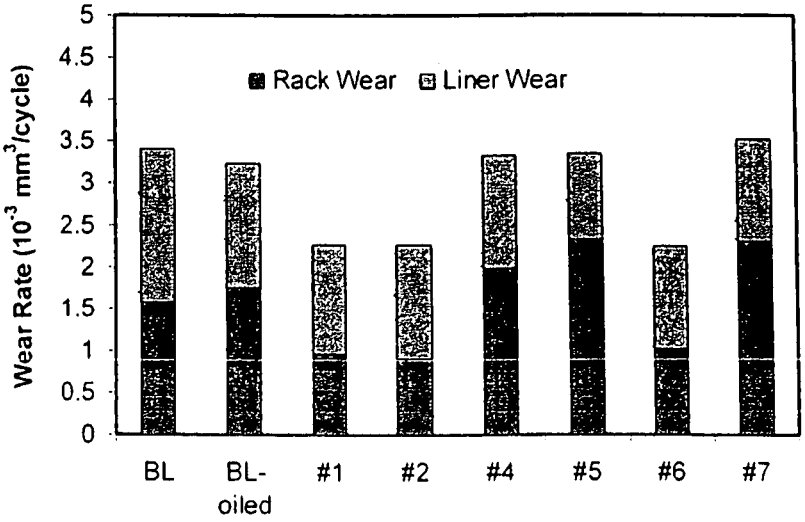
Fig. 14B Friction behavior (13 N, 600 cycles)

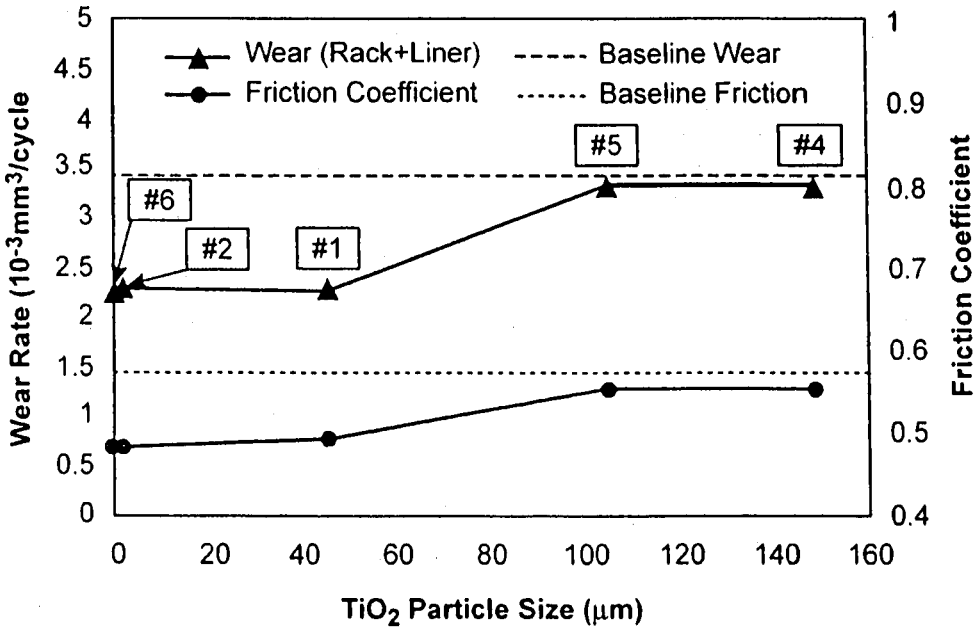
Fig. 15 Effects of $TiO_2$ particle size

OVEN RACK HAVING INTEGRAL LUBRICIOUS, DRY PORCELAIN SURFACE

CROSS-REFERENCE TO RELATED APPLICATION

This is the U.S. national phase of PCT/US2007/012398 filed May 24, 2007, which itself is a continuation-in-part of U.S. application Ser. No. 11/440,992 filed May 25, 2006. The entire disclosures of the priority documents are incorporated herein by reference in their entirety.

STATEMENT REGARDING FEDERALLY SPONSORED RESEARCH

The United States Government has certain rights in this invention pursuant to contract no. DE-AC05-00OR22725 between the United States Department of Energy and UT-Battelle, LLC.

NAMES OF PARTIES TO A JOINT RESEARCH AGREEMENT

Certain aspects of this invention arose under Work for Others Agreement No. NFE-06-00197 between UT-Battelle, LLC and SSW Holding Company, Inc.

FIELD OF THE DISCLOSURE

The present disclosure is directed to glass, ceramic or porcelain coated metal products wherein the porcelain coating has a lubricious surface such that repeated sliding contact against another porcelain surface achieves measurable improvement in the form of reduced marring, chipping or flaking of the porcelain of either porcelain surface. In the preferred embodiment, these products are porcelain-enameled steel oven racks that are subjected to temperatures above 500° F., usually above 900° F., as in self-cleaning, pyrolytic ovens, and the metal is steel wire that has the composition disclosed in this assignee's U.S. Pat. Nos. 6,837,235 and 6,915,552, both hereby incorporated by reference. Alternately, the product can be formed of cast iron, such as a burner grate. The preferred combination of the steel wire together with the lubricious porcelain coating provides oven racks which do not discolor during cooking or during self-cleaning cycles when the oven racks remain in the oven, and the porcelain coating does not spall, fish-scale or chip, as a result of hydrogen out-gassing, which might otherwise occur from steel at the high temperatures of self-cleaning cycles. Further, the porcelain surface of the oven rack has improved wear performance when measuring the result of regular sliding contact of the porcelain oven rack surface against either an oven wall porcelain rib liner surface or a porcelain coated so-called ladder rack during movement of the oven racks into and out of the oven, surprisingly even when the oven rack supports a heavy cooking load, at high cooking temperatures of 350-600° F., or during shipping of the oven and rack to the point-of-sale or to the ultimate consumer.

BACKGROUND AND PRIOR ART

As described in this assignee's U.S. Pat. Nos. 6,837,235 ('235) and 6,915,522 ('522), when a glass-coated steel wire oven rack is subjected to temperatures above 900° F., there is an emission of hydrogen gas from the steel upon cooling from that temperature, and absent a preventive expedient, the emitted hydrogen gas will attempt to escape from the steel through the glass coating causing the glass coating to chip, spall or crack.

There is no solution to preventing the chipping, spalling or cracking of glass-coated steel wire oven racks or of glass-coated drawn steel rod articles, with the exception of the solution described in this assignee's '235 and '522 patents and pending application Ser. No. 11/040,641, filed Jan. 21, 2005.

As described in this assignee's '235 and '522 patents, the drawn steel rod is subjected to at least 20% reduction in diameter during cold drawing; and the rod, at the time it undergoes drawing, is composed of steel comprising up to about 0.08% carbon and about 0.001 to about 0.2% of a carbon stabilizing transition metal selected from vanadium (V), titanium (Ti), niobium (Nb) and tantalum (Ta). This, combination of features enables the glass-coated drawn steel rod article or wire oven rack to overcome the glass chipping or cracking problem as a result of hydrogen out-gassing.

In addition to the hydrogen out-gassing problem experienced at high temperatures with porcelain-encapsulated steel oven racks, another very significant problem has more recently been discovered during the manufacture, testing and use of the porcelain-coated oven racks. It has been found that the porcelain can deteriorate by marring, flaking or chipping off of the porcelain material from the oven racks as a result of the normal periodic sliding contact between the oven rack porcelain surface and a contacting porcelain wall surface of the oven cavity. That is, over the 13 to 15 year normal life expectancy of an oven, the repeated sliding porcelain-to-porcelain contact upon insertion and removal of the porcelain-coated oven racks, particularly when the oven racks are supporting a relatively heavy cooking load, can cause unwanted abrasion, chipping and squeaking of the sliding porcelain surface (of one type) against and across a porcelain surface (of the same or another type) on the oven wall. The identification of a suitable porcelain composition that solves this problem was found to be a daunting task since the porcelain composition must be strong enough to solve the chipping, spalling and fish-scaling problems that may result from the hydrogen out-gassing of the carbon steel as well as resist damage resulting from continued heating and cooling cycles experienced in cooking, and especially the high temperatures of self-cleaning oven cycles, while maintaining sufficient lubricity and hardness to pass enumerable quality tests typically required for a porcelain material to be suitable as an oven rack. For example, a suitable porcelain material for an oven rack must pass a lubrication test; gloss test; adherence test; thickness test; fish-scale test; must be resistant to acids; resistant to alkaline materials; be resistant to crazing; be resistant to abrasion; pass a rubbing test; blurring test; toxicity test; humidity test; specific gravity and corrosion test as well as others. Porcelain quality tests generally are specified in the Manual of Tests, Measurements and Process Controls PEI-1101, an enameling manual well known in the art, hereby incorporated by reference. Even other such tests for porcelain quality are set by ASTM standards.

After-coating the oven rack with a liquid lubricant, such as the prior art method of using vegetable oil, requires repeated reapplication of vegetable oil since the oil dissipates, e.g., burns off, in both continuous-cleaning and self-cleaning oven cycles and also somewhat during other oven usage such as normal cooking cycles. Prior to this assignee's out-gassing solution, as described in the '235 and '522 patents, commercially satisfactory porcelain-coated oven racks to be used in self-cleaning pyrolytic ovens were non-existent so that assistance in attempting to solve the porcelain-to-porcelain abrasion and flaking problem in porcelain materials that are regularly subjected to temperatures above 900° F. was not forthcoming from the prior art.

SUMMARY OF THE DISCLOSURE

Described herein is a lubricious porcelain-coated metal oven rack designed to be received within an oven cavity. In the preferred embodiment, the coated metal oven rack includes a plurality of elongated steel wire members formed of a special steel composition and joined together to form an oven rack having an outer surface; wherein the diameter of the steel rod material is reduced by at least about 20% when the steel rod material is drawn to form the steel wire; the outer surface of the oven rack being coated by a glass material having a lubricious, integral, dry outer surface, the glass material preferably being porcelain. The amount of carbon in the steel rod material, the amount of carbon stabilizing transition metal in the steel rod material and the degree to which the cross-sectional area of the steel rod material is reduced, when the steel wire is drawn from the steel rod material, is selected, i.e., balanced, so as to prevent chipping of the glass material away from the outer surface due to the release of hydrogen gas from the steel wire members when the steel wire is either heated or cooled.

In preferred embodiments, the glass material having a lubricious outer surface, preferably porcelain, is coated onto the steel wire in two distinct coating steps, wherein the lubricious (porcelain-to-porcelain friction-decreasing) additive may be homogenous throughout the two porcelain coatings; only in the outer coat (of the two porcelain coats); or may be provided only as a surface feature, such as by treating the porcelain outer surface using a process step that provides lubricity only to the outer surface of the porcelain.

In a preferred embodiment, the coated steel wire products described herein are oven racks designed to be received within an oven cavity. The coated steel wire oven rack includes a plurality of elongated steel wire members joined together to form an oven rack having an outer surface. The plurality of elongated steel wire members are made from a steel rod material containing from about 80 to about 99.9% by weight of iron; from up to about 0.08% by weight of carbon, e.g., 0.001% about 0.08% carbon, preferably from about 0.002% to about 0.05%, and more preferably from about 0.005% to less than about 0.05% by weight carbon, and most preferably from about 0.005% to about 0.03% by weight carbon; and from about 0.001 to about 0.2% by weight of a carbon stabilizing transition metal selected from the group consisting of Vanadium, Tantalum, Titanium, Niobium, and mixtures thereof. The plurality of elongated steel wire members are made from the steel rod material by drawing the steel rod material to form steel wire; wherein the cross-sectional area of the steel rod material is reduced by at least about 20% when the steel rod material is cold drawn to form the steel wire. The outer surface of the oven rack is coated by a glass material, preferably porcelain, having a lubricious outer surface, wherein the amount of carbon in the steel rod material, the amount of carbon stabilizing transition metal in the steel rod material and the degree to which the cross-sectional area of the steel rod material is reduced when the steel wire is drawn from the steel rod material is selected, i.e., balanced, so as to prevent chipping of the porcelain away from the outer surface due to the release of hydrogen gas from the steel wire material when the steel wire material is either heated or cooled. In a preferred embodiment, the porcelain is coated onto the steel in two distinct coating steps preferably in two distinct electrostatic coating processes, followed by a single heating process in which the temperature is preferably raised to about 1550° F. or cured using infrared (IR) or other glass frit fusing techniques known in the porcelain coating or porcelain enameling art. In alternate embodiments, the heating process may be repeated and in yet other alternate embodiments, a wet coating, CVD, physical vapor deposition (PVD) or other processes can be used for applying the porcelain coat(s) to the steel wire oven rack.

The plurality of elongated steel wire members are made from steel rod material containing from about 80 to about 99.9% by weight of iron, up to about 0.08% by weight carbon, e.g., from about 0.001 to about 0.08% by weight of carbon, and from about 0.001 to about 0.2% by weight of a transition metal that will have a stabilizing effect on the carbon in the elongated steel wire members such that the carbon absorbs less hydrogen gas when the steel wire member is heated to temperatures above 500° F. than it would in the absence of the carbon stabilizing transition metal. In preferred embodiments, the transition metal is selected from the group consisting of Vanadium, Tantalum, Titanium and Niobium, and in the most preferred embodiment, the transition metal is Vanadium. The plurality of elongated steel wire members are preferably made from steel rod material by a cold drawing process to reduce the diameter of the steel wire. In the preferred process, the steel rod is pulled through a cold die that gradually reduces in diameter so that the rod is drawn repeatedly through the die and the cross-sectional area of the rod is reduced to form a steel wire having a cross-sectional area of diminished diameter. In preferred embodiments, the diameter of the steel wire is diminished at least about 20%, preferably at least about 30%, more preferably at least about 40%, even more preferably at least about 45%, and most preferably at least about 50%. It will be appreciated that the diameter reduction creates voids in the steel wire which are desirable to provide cavities into which hydrogen gas can be received and, perhaps, compressed, without creating pressure to be released from the surface of the steel wire once the steel wire is coated with porcelain. It will be appreciated, that the diameter reduction, which creates cavities in the steel wire, and the inclusion of carbon stabilizing transition metal elements so that the steel absorbs hydrogen, will diminish the degree to which hydrogen gas out-gassing causes cracking, spalling and chipping of the porcelain surface of the elongated steel wire members of the oven rack which are coated by the glass material.

In other embodiments, the metal structure coated with a lubricious glass material may be cast iron; or other identified materials such as Type I, II or III porcelain enameling steels, (as described in Manual for Selection of Porcelain Enameling Steels PEI-201), hereby incorporated by reference; or any metal that will not cause chipping, flaking, spalling or fish-scaling of the glassy coating when subjected to temperatures of a self-cleaning cycle of an oven above 500° F., preferably above 900° F.

Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

The above-described features and advantages along with various advantages and features of novelty are pointed out with particularity in the claims of the present disclosure which are annexed hereto and form a further part hereof. However, for a better understanding of the disclosure, its advantages and objects attained by its use, reference should be made to the drawings which form a further part hereof and to the accompanying descriptive matter in which there is illustrated and described preferred embodiments of the preferred disclosure.

BRIEF DESCRIPTION OF DRAWINGS

Referring to the drawings, where like numerals refer to like parts throughout the several views:

FIGS. 13A, 13B, 14A and 14B are bar graphs showing the friction and wear behavior at 50N and 1000 cycles (FIGS. 13A and 13B) and 13N, 600 cycles (FIGS. 14A and 14B) on the baseline and seven test samples; and FIG. 15 is a graph comparing wear and friction coefficient on the baseline and test samples containing $TiO_2$ in relation to $TiO_2$ particle size.

DETAILED DESCRIPTION OF THE PREFERRED EMBODIMENTS

Figures 1, 2, 3:
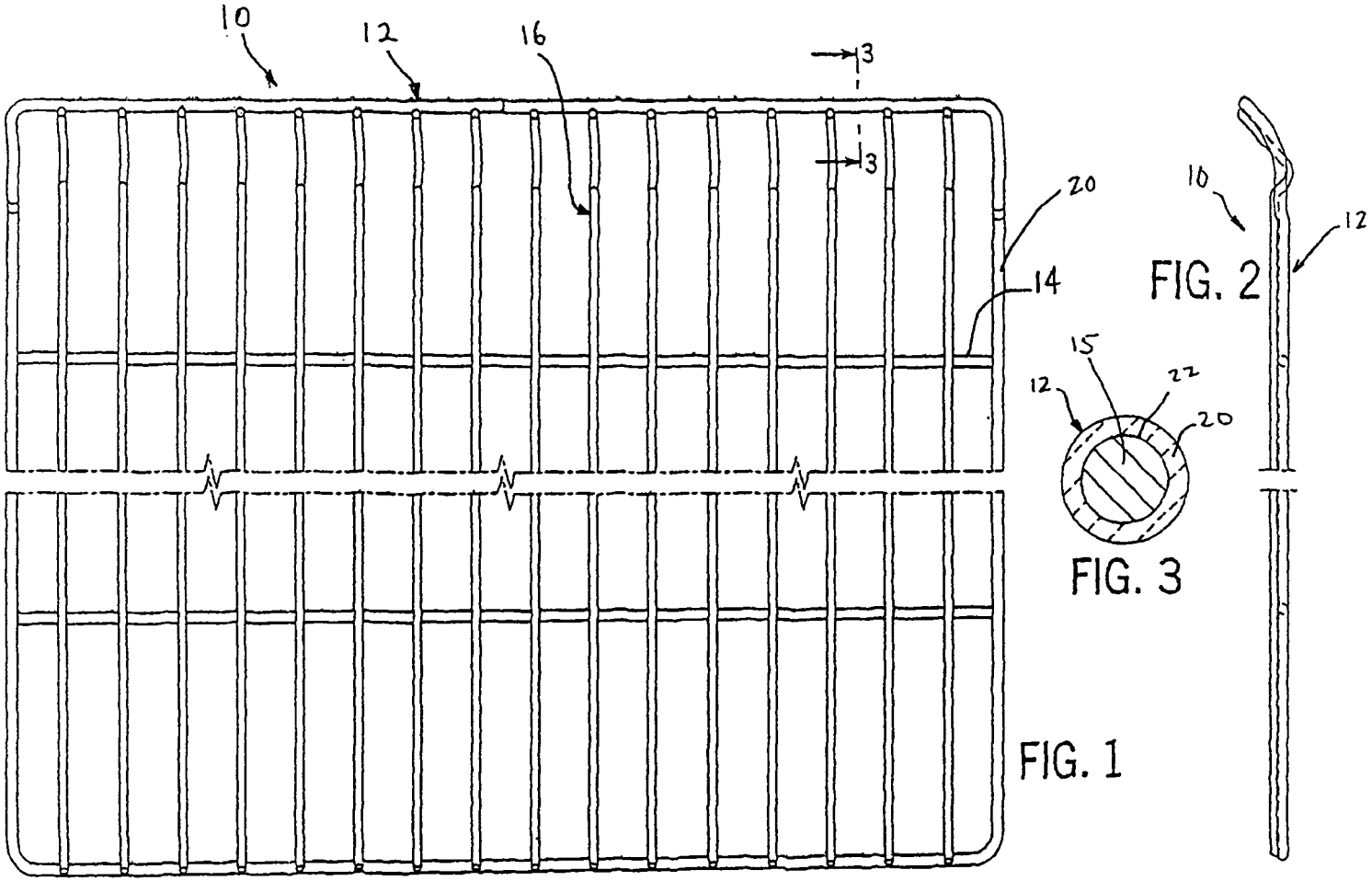
FIG. 1 is a plan view of a coated oven rack in accord with the present disclosure.
FIG. 2 is a side view of the oven rack shown in FIG. 1.
FIG. 3 is a cross-sectional view of an outside framing wire 12 as seen from the line 3-3, of FIG. 1.

A lubricious outermost or uppermost surface on the oven rack porcelain coating can be achieved either by mixing a dry lubricant refractory powder homogeneously into the porcelain composition and then applying the porcelain composition to the steel oven rack; or the porcelain coating can be applied to the steel oven rack and sintered followed by coating the sintered porcelain with a lubricious, temperature-resistive coating composition. When a dry lubricant surface layer is applied over a sintered porcelain coating, the dry lubricant active material may form a portion of the uppermost coating layer of the porcelain material, dispersed homogeneously in additional fine powdered refractory materials or, the dry lubricant active material may be discontinuously or continuously embedded into the surface of the porcelain coating material as disclosed in U.S. published application 2006/0089270 A1, hereby incorporated by reference.

In accordance with a preferred embodiment, the lubricious porcelain material is coated over the steel oven rack in one or more coating steps, preferably multiple coating steps, using an electrostatic dry powder spray. Other suitable coating methods include wet spray, electro-static wet spray, wet flow coating, wet dip, electro-phoretic deposition (EPE-electrophoretic enameling), chemical vapor deposition (CVD), physical vapor depositions (PVD), plasma deposition, and sputtering. At least this surface coating layer, as applied on at least the sidebars (i.e., edge framing wires of the oven rack) that contact the oven cavity side wall and/or its protruding rack supports, should include a dry lubricant-containing composition in an amount of about 0.1% to about 20% by weight, preferably about 0.5% to about 10% by weight, more preferably about 2% to about 5% by weight, and most preferably about 3% by weight. The selected dry lubricant used cannot otherwise compromise the final porcelain coating on the oven rack, as such porcelain coating must still pass the above-mentioned, required quality control tests for porcelain-coated oven racks. Suitable dry lubricant porcelain additives include homogeneously distributed fine powdered particles, e.g., 1 nm to about 200 μm, preferably 5 nm to about 200 μm, more preferably 10 nm to less than about 105 μm, more preferably 20 nm to less than 45 μm, of carbon; graphite; boron nitride, preferably cubic boron nitride; molybdenum (IV) sulfide; molybdenum disulfide; molybdenum sulfide; molybdenum (IV) selenide; molybdenum selenide, tungsten (IV) sulfide, tungsten disulfide, tungsten sulfide, silicon nitride ($Si_3N_4$); TiN; TiC; TiCN; $TiO_2$; TiAlN; CrN; SiC; diamond-like carbon; tungsten carbide (WC); zirconium oxide ($ZrO_2$); zirconium oxide or 0.1 to 40 weight % aluminum oxide; alumina-zirconia; and/or antimony or its oxides or trioxides. The dry lubricant is conveniently distributed throughout the porcelain or glass frit outermost coating composition in one of two ways. First, it can be done by adding the dry lubricant to the glass frit (porcelain composition) and then milling the entire porcelain composition containing the dry lubricant to the final particle size distribution, so that the dry lubricant has approximately the same particle size as the other glass components. Second, it can also be done by manually adding the dry lubricant to the porcelain outermost coating composition. The particle size of the glass frit or porcelain compositions described herein is not critical and should be the common particle size distribution used by those skilled in the art of porcelain enameling of steel, e.g., 5 μm to about 200 μm. The lubricious porcelain composition can be adhered to the metal oven rack in any manner known in the art, e.g., electrostatically, preferably by electrostatic dry powder spray, as in electro-porcelain enameling. If the porcelain powdered material is difficult to adhere, a nickel-based or cobalt-based pretreating composition may be coated on the steel prior to the porcelain coating for better adherence of the porcelain to the metal oven rack, as well known in the art.

In another embodiment, the porcelain-coated steel is overcoated (i.e., over the base porcelain coat) with a ceramic wear-resistant powdered refractory composition, generally in a thin layer, e.g., 1 to 10 mils, of wear-resistant ceramic material having, for example, a particle size in the range of about 5 to about 200 microns, preferably about 10 to about 45 microns, followed by sintering, wherein the dry lubricant included in at least a top layer (outermost coating) of the ceramic material, has a particle size is in the range of 1 nm to about 200 μm, preferably 5 nm to about 200 μm, more preferably 10 nm to less than about 105 μm, more preferably 20 nm to less than about 45 μm.

In one embodiment, the lubricious wear material is a ceramic wear-resistant powder such as a carbide, particularly a chrome carbide. The chrome carbide is typically a material such as $Cr_{23}C_6$, $Cr_7C_3$, $Cr_3C_2$, and combinations thereof. The chrome carbide is generally in the form of a pre-alloyed carbide powder, wherein the particles of the powder are homogeneous and uniform throughout their cross sections. Alternatively, the chrome carbide, such as $Cr_3C_2$, is blended with another material, such as NiCr which functions as a metallic binder. The carbide may be subsequently treated with a halogen etchant gas at high temperature to provide additional lubricity in the integral surface thus-formed, as described in U.S. Pat. No. 6,579,833, hereby incorporated by reference.

In another embodiment, the particulate material for the lubricious coating is comprised of an alloy wear material. In this case, it is advantageous to utilize an alloy that forms a lubricious oxide film over its surface during actual use, which oxide functions to lubricate the interface between the treated porcelain surfaces of the oven racks and the porcelain surfaces of the oven cavity walls at high temperatures (e.g., at least about 900° F. during oven cleaning) to reduce wear. For example, wear is reduced due to presence of the oxide forming alloy during the self-cleaning oven cycle. One particular group of materials that forms a lubricating or lubricious oxide film includes cobalt alloys. Suitable cobalt-based lubricious alloys include the following:

(1) 28.5 wt % molybdenum, 17.5 wt % chromium, 3.4 wt % silicon, balance cobalt;
(2) 22.0 wt % nickel, 22 wt % Cr, 14.5 wt % tungsten, 0.35 wt % silicon, 2.3 wt % boron, balance cobalt;
(3) 10 wt % nickel, 20 wt % Cr, 15 wt % tungsten, balance cobalt;
(4) 22 wt % nickel, 22 wt % Cr, 15.5 wt % tungsten, balance cobalt; and
(5) 5 wt % nickel, 28 wt % Cr, 19.5 wt % tungsten, balance cobalt.

The lubricious, wear resistant outer coating is fused to the underlying porcelain by heating to the fusing temperature, e.g., 1550-2000° F. followed by cooling. Alternatively, the lubricious wear-resistant cobalt or chrome carbide material or cobalt-based alloys can be applied directly to the metal oven rack and fused thereon to provide the lubricious, wear-resistant surface.

Other useful methods of applying the initial porcelain coating over the steel oven rack or for applying a final lubricious coating layer over the base porcelain layer, include chemical vapor deposition and plasma deposition, as well as sputtering. It should be noted that sputtering is a momentum transfer process wherein atoms of the coating material are bombarded onto an underlying porcelain layer by energetic particles. The bombarding species are generally ions of a heavy inert gas, such as argon. The sputtered dry lubricant atoms collide repeatedly with the heavy inert gas atoms before reaching the porcelain layer where they condense to form a coating of the lubricious, wear resistant outer layer. As well known in the art, the underlying porcelain layer may be given a pretreatment, e.g., a plasma treatment to help the outer lubricious, wear-resistant layer adhere to the outer surface of an underlying porcelain layer. Plasma ion bombardment of the outer surface of an underlying porcelain layer may be useful to modify the outer layer of the porcelain by plasma etching in order to achieve better adherence of an outermost layer of lubricious, wear-resistant refractory powder material in order to achieve excellent bonding of the final lubricious coating layer.

Another excellent final finishing lubricious surface coating material includes the self-lubricating material PS-200 developed by NASA, which is a chromium carbide matrix having particles of silver and calcium fluoride-barium fluoride eutectic dispersed therein. In accordance with this embodiment, the chromium carbide matrix may be applied directly over an underlying porcelain material or, as described in U.S. Pat. No. 5,413,877, hereby incorporated by reference, the underlying material may be a zirconia thermo barrier material and the outer chromium carbide layer may be nickel alloy-bonded thereto.

In accordance with still another embodiment of providing an outer lubricious, wear-resistant temperature-resistant outer surface on the oven rack and/or interior surface of the oven cavity, the glassy or porcelain material can be formed from a metal carbide, such as silicon carbide, and treated in a halogen-containing gaseous etchant at high temperature, e.g., about 100° C. to about 4000° C., preferably about 800° C. to about 1200° C. in order to form an integral carbon or diamond surface on the metal carbide, as disclosed in U.S. Pat. No. 6,579,833, hereby incorporated by reference. Another method for forming a diamond surface on the outside of the oven rack or exterior of the oven cavity is disclosed in U.S. Pat. No. 5,108,813 and published U.S. Application No. 2006/0059688 A1, both of which are hereby incorporated by reference.

Figure 10:
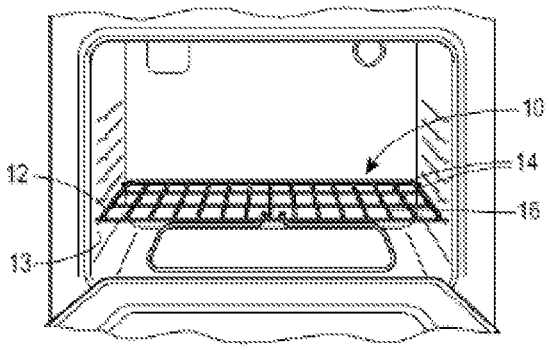
FIG. 10 is a broken-away front view of an oven showing a lubricious porcelain-coated oven rack positioned within a porcelain-coated oven cavity.

Referring now to the drawings, and in particular FIGS. 1-3, a lubricious, dry porcelain-coated metal wire oven rack 10 is shown having a lubricious, dry outer surface thereon and/or on the porcelain coating 13 of the oven where the oven rack 10 slides into position within the oven cavity (see FIG. 10). Preferably, the oven rack 10 has an entire outer surface that is lubricious, but it is only necessary to provide the lubricious material in or on an outside edge framing wire portion 12 or on the oven side walls where the outside edge framing wire 12 contacts the oven cavity. The porcelain-coated metal oven wire rack 10 includes the outside edge framing wire 12 stabilized by two frame stabilizing support wires 14 and a series of upper surface metal wire members 16 which generally run front to back to provide an upper support surface for oven utensils (not shown) that are placed on the coated oven rack 10. Preferably the upper support surface also includes the lubricious porcelain surface for helping reduce abrasion, chipping, flaking, spalling and other damage to the porcelain material during insertion and removal of cooking pans and utensils.

Figure 5:
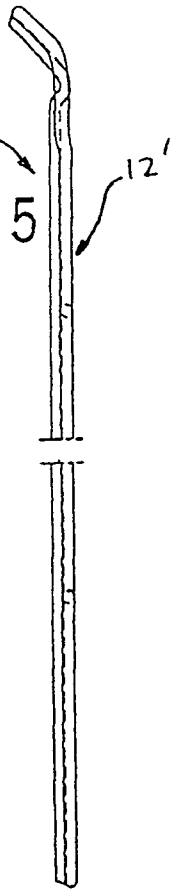
FIG. 5 is a side view of the alternate oven rack shown in FIG. 4.
Figure 6:
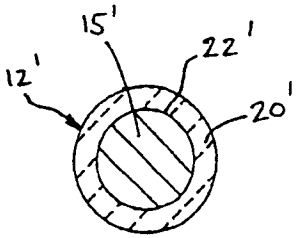
FIG. 6 is a cross-sectional view of an outside framing wire 12' as seen from the line 6-6 of FIG. 4.
Figure 4:
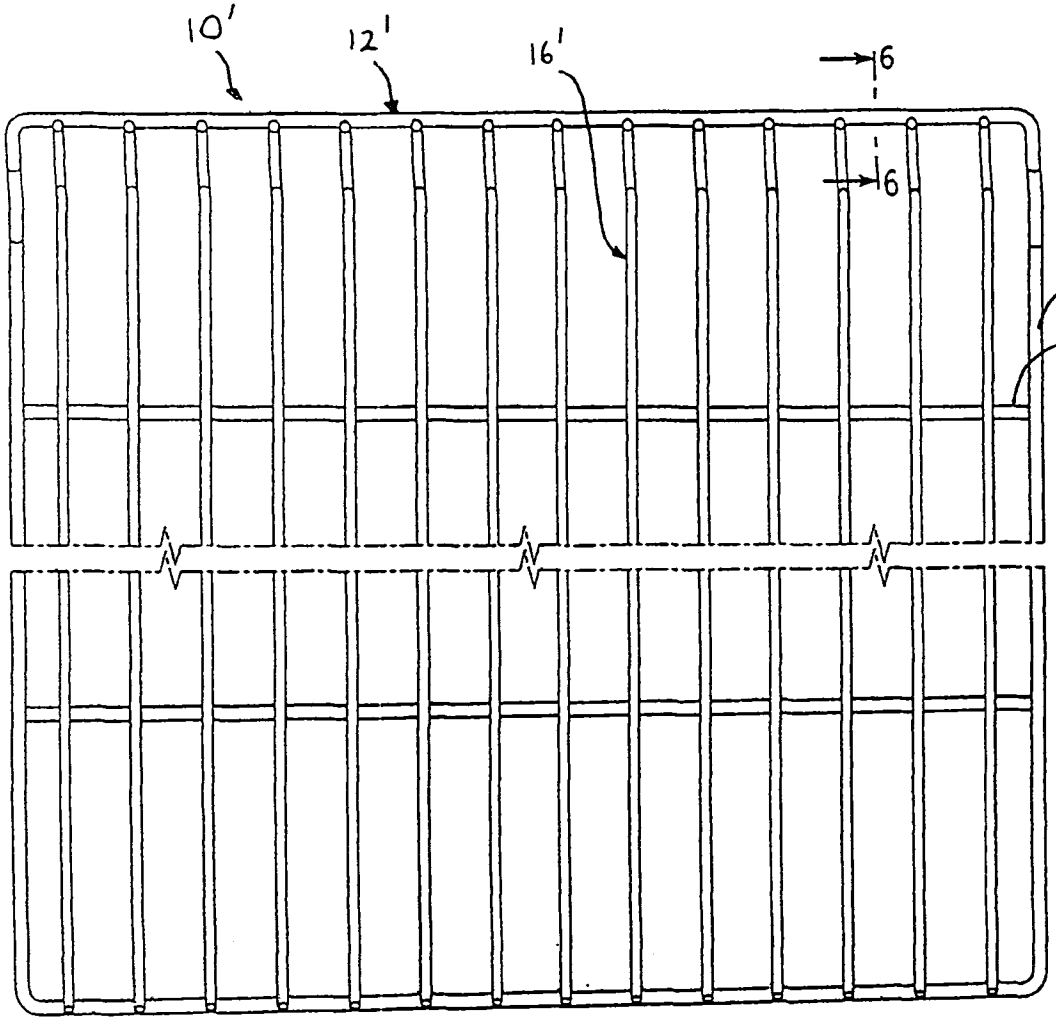
FIG. 4 is a plan view of an alternate oven rack in accord with the present disclosure.

Referring now also to FIGS. 4-6, an alternate oven rack 10', as described herein, is shown that has only minor differences from the oven rack 10 shown in FIGS. 1-3.

Figures 7, 8, 9:
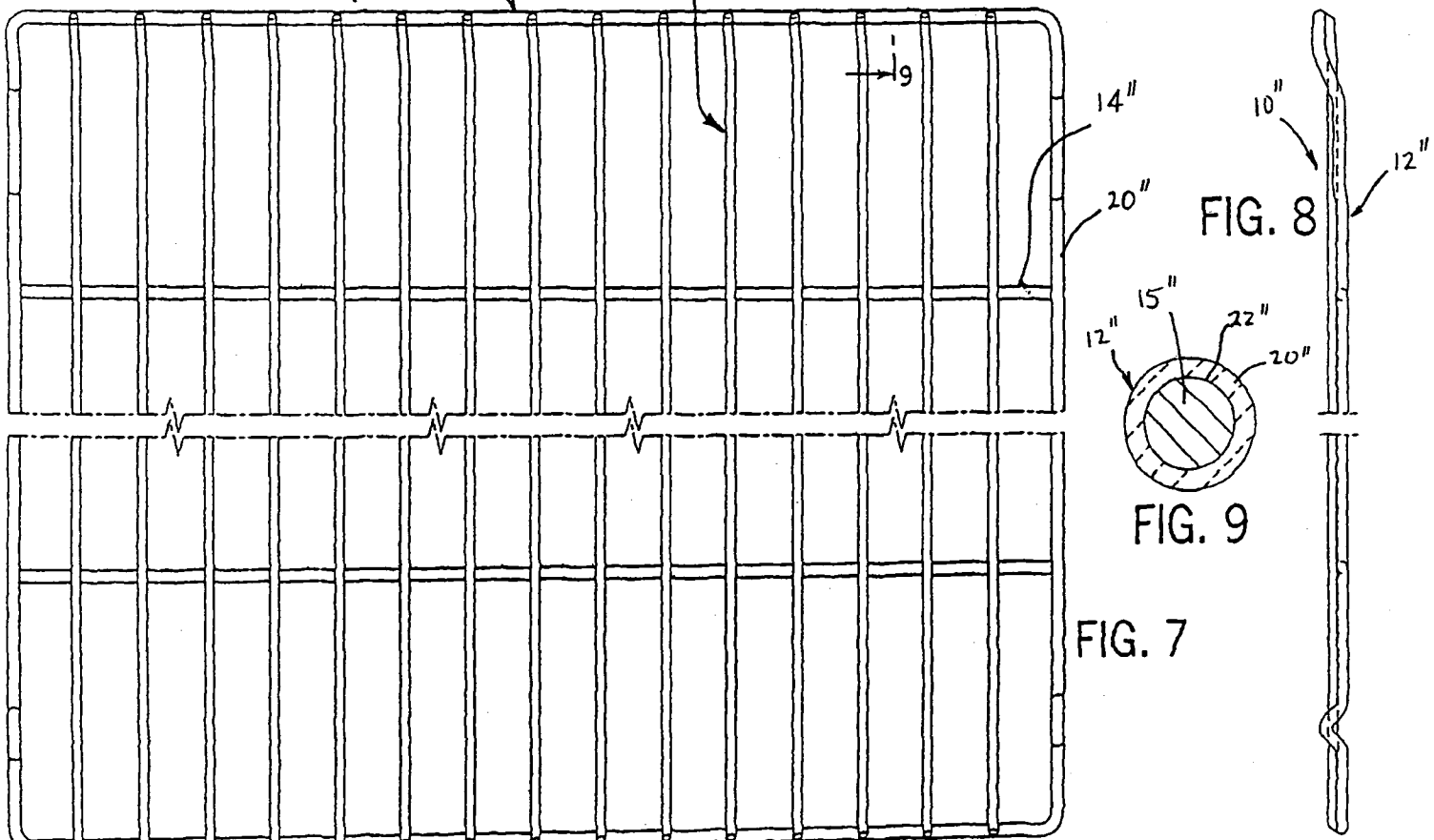
FIG. 7 is a plan view of a further alternate oven rack in accord with the present disclosure.
FIG. 8 is a side view of the oven rack shown in FIG. 7.
FIG. 9 is a cross-sectional view of an outside framing wire 12' as seen from the line 9-9 of FIG. 7.

Referring now also to FIGS. 7-9, a further alternate oven rack 10" in accordance with the articles and method described herein is shown, having a few other minor differences, but in most other ways being virtually the same as the oven racks shown in FIGS. 1-6.

The preferred oven rack 10 is coated with a lubricious glass material 20, preferably porcelain, which is coated onto the outer surface 22 of welded steel wire parts 15 of the coated oven rack 10, in a process which generally follows these steps. Steel rod material (not shown) is preferably purchased, which is made primarily of iron but includes the elemental composition shown below, in Table 1.

TABLE 1

| PORCELAIN WIRE SUBSTRATE B SPECIFICATIONS | | | |
|---|---|---|---|
| | 0.259 Diam. | 0.192 Diam. | 0.239 Diam. |
| Rod Size | 5/16 | 9/32 | 5/16 |
| Area Reduction | 31% | 53% | 41.50% |
| Chemistry | Substrate B | | |
| | 0.259 Diam. | 0.192 Diam. | 0.239 Diam. |

TABLE 1-continued

| PORCELAIN WIRE SUBSTRATE B SPECIFICATIONS | | | |
|---|---|---|---|
| Carbon | 0.046% | 0.052% | 0.051% |
| Vanadium | 0.014% | 0.012% | 0.013% |
| Manganese | 0.350% | 0.360% | 0.340% |
| Phosphorus | 0.004% | 0.003% | 0.003% |
| Sulfur | 0.004% | 0.004% | 0.005% |
| Silicon | 0.130% | 0.140% | 0.130% |
| Copper | 0.110% | 0.100% | 0.120% |
| 1" Sample Size | Substrate B (pre-fire) | | |
| Tensile Testing | 0.259 Diam. | 0.192 Diam. | 0.239 Diam. |
| Yield Strength | 88200 | 100300 | 98600 |
| Ultimate Strength | 89700 | 103400 | 102600 |
| % Elongation in 1" | 21 | 15 | 20 |
| % Reduction of Area | 71 | 67 | 67 |
| 1" Sample Size | Substrate B (post-fire) | | |
| Tensile Testing | 0.259 Diam. | 0.192 Diam. | 0.239 Diam. |
| Yield Strength | 57200 | 41400 | 51900 |
| Ultimate Strength | 71700 | 58100 | 70000 |
| % Elongation in 1" | 40% | 43% | 37 |
| % Reduction of Area | 77% | 80% | 79 |

PEMCO POWDER—1st Coat: GP2025 (CAS#65997-18-4), 2nd Coat: GP1124 (CAS#65997-18-4, plus 0.1-20% dry lubricant)

Furnace Line Speed: 22 ft/min (494 hangers/hour), 988 parts/hour

Washer Line Speed: 22 ft/min (494 hangers/hour), 988 parts/hour 4-10 mil thickness 1585° F. Zone 1 Temp.

1543° F. Zone 2 Temp.

25 minutes in furnace 10,000 lbs/hr maximum line capacity

Specific Gravity: 2.59

The preferred steel rod is then drawn in an area reduction process, preferably through a cold (e.g., room temperature) die, to reduce the diameter of the cross-sectional area, preferably at least about 20%, more preferably at least about 30%, more preferably at least about 35%, even more preferably about 40%, even more preferably about 45%, and most preferably about 50%, in order to incorporate cavities within the steel wire which allow steel wire-released hydrogen to be received within the cavities and also to reduce the diameter of the wire to that which is desired. The table above gives the general specifications for non-iron elements and other aspects of the steel wire and the steel rod used to make the steel wire.

Once the preferred steel rod is converted into wire in the wire drawing process, the steel wire is straight cut to predetermined lengths according to need. The various cut steel wire members are then formed, e.g., bent, as needed to provide the various parts of the coated oven rack. These parts are then welded together to form an oven rack substrate (not shown), for subsequent coating, in a standard welding operation. The oven racks are then cleaned in a washing process and then power acid washed with an electrically charged acid wash material to remove any remaining weld scale. The rack is then dried in an oven at about 500° F. and then air cooled. The clean oven rack is then sprayed with powdered glass preferably in an electrostatic charged paint (porcelain enameling) process in which the oven rack substrate is charged negatively and the glass powder is charged positively. Other metal rack-cleaning methods may be used e.g., blasting (glass beads, steel balls or sand) ultrasonic cleaning, high temperature or low temperature alkaline cleaning or acid cleaning; or the like.

The preferred spraying process (electrostatic dry powder spray) is divided into a first coating process in which a first or base coat is placed upon the oven rack substrate. In preferred embodiments the first coat is a Pemco powder, GP2025 (CAS#65997-18-4) from Pemco International Corp. It will be appreciated that other similar or equivalent porcelain powders may also be used in alternate embodiments. After the first coat is applied a second or top coat is applied using the same process. In preferred embodiments, this top coat is a Pemco powder, GP1124, from PEMCO (CAS#65997-18-4) containing 0.1% to about 20%, preferably 0.5% to about 10% of a dry lubricant refractory material having a particle size less than about 200 μm, preferably less than about 105 μm, more preferably less than about 45 μm, as previously described. If desired for aesthetic reasons, the final coating may also include a coloring refractory material, such as $TiO_2$, generally of a much larger particle size, e.g., >200 μm, added to the milled porcelain composition and homogeneously distributed, in an amount of about 0.1 to 10% by weight, more preferably about 1% to about 5%, to provide white surface fleck coloring in the otherwise black composition. Again, it will be appreciated that other similar or equivalent powders containing the active dry lubricant powder, distributed homogeneously throughout, may also be used in alternate embodiments. The coated oven rack substrate is then heated in an oven to about 1500-1600° F., e.g., about 1550° F. for about 25 minutes and then cooled. This coating and baking process is generally referred to as a double coat, single fire coating process. The coated oven racks are then cooled and then packaged for shipping to the customer. It is to be noted that, in view of the lubricious outer coating, and contrary to the prior art, the lubricious outer surface is dry, and no additional step of then after-coating the finished porcelain-coated steel wire oven rack with a suitable liquid lubricant, such as vegetable oil, e.g., Wesson oil, is needed.

In an alternate process to provide a lubricious outer coating, the oven rack substrate is coated using a wet spray process, wherein the porcelain is coated onto the steel wire, in number of steps selected from each of five distinct wet coating processes including wet spray, electrostatic wet spray, wet flow coating, wet dip or electro-phoretic deposition, or, more specific, as applied to porcelain, "EPE-Electro-phoretic enameling." This later process involves the use of a dip system where electric power is used to deposit porcelain enamel material on a metal surface. The wet coating processes can be single step, double step or multiple step processes followed by at least single or double heating process steps in which the temperature is preferably raised to a temperature in the range of about 1500° F. to about 1600° F., preferably about 1550° F. In these processes, porcelain can be coated to steel by any well known basic methods of wet spraying by air atomization, including hand spraying, automatic spraying and electrostatic spraying. When the steel oven rack is processed through a dipping operation, the part is immersed in the "slip", removed, and the slip is allowed to drain off. In flow coating, the slip is flowed over the part and the excess is allowed to drain off. Carefully controlled density of the porcelain enamel slip and proper positioning of the part is necessary to produce a uniform coating by dip or flow coat methods. The dry lubricant-containing porcelain composition can be coated on the steel oven racks by immersion or flow coating, as well, by five basic methods: hand dipping, tong dipping, automatic dip machines or systems, electro-phoretic deposition systems and flow coating. It will be appreciated that any number of these various methods may be adapted for use in providing a final porcelain layer or surface that is sufficiently lubricious for porcelain-to-porcelain sliding contact without the need for a subsequently-added liquid or oil lubricant for wear-resistance or any periodic re-applications of the same to the oven rack by the ultimate consumer.

Other potential metal substrates to receive a lubricious porcelain coating can include Type I, II, and III porcelain enamel coated steels, as described in PEI-201 Manual for Selection of Porcelain Enameling Steels. Examples of other porcelain coated wire, cast iron or other metal products to receive a lubricious porcelain coating in addition to porcelain coated oven racks includes ladder racks, barbeque grill racks and stove burner grates.

Experimental

Some of the above-mentioned dry lubricant materials were tested for their tribological properties as coatings on the oven racks described herein.

Hardness

Figure 12:
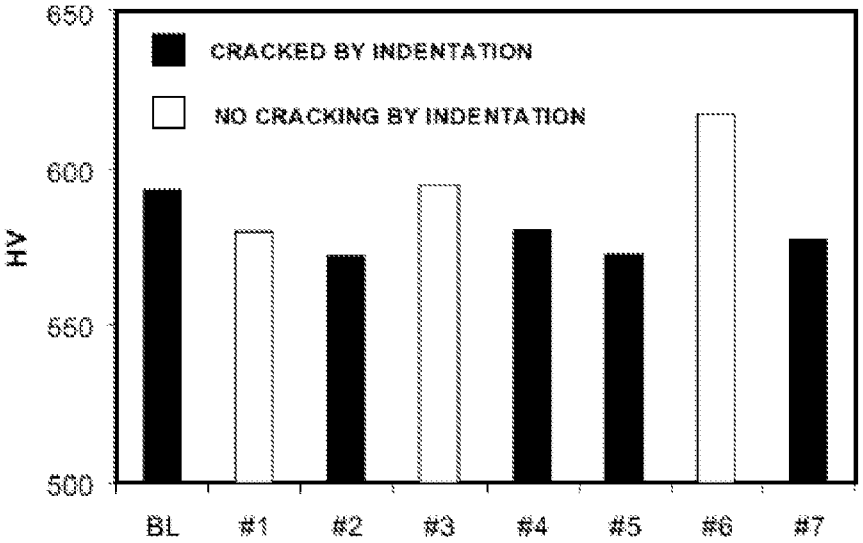
FIG. 12 is a bar graph showing the Vickers microindentation hardness values collected on a baseline and seven test samples containing different dry lubricants in the oven rack porcelain coatings (top coat)

The Vickers microindentation hardness values of the baseline and modified coating are shown in FIG. 12. There are two observations:

Most modified coatings were slightly softer than the baseline except #6 that turned out to be harder.

The #1, #3, and #6 coatings had no visible cracking under indentation, implying their less brittleness compared with the baseline and others (#2, #4, #5, and #7) that clearly showed indentation-induced cracks.

Friction and Wear Tests

Eight racks with seven modified enamel coatings (#1-7) and a baseline were tested. Coating specifications are show in Table 2. (The coating thicknesses were calculated based on the wear scar measurements described later.)

The $WS_2$ additive produced non-smooth porous enamel coating (#3), because the curing temperature (1150° F.) was above the critical oxidation temperature (1000° F.) of $WS_2$.

TABLE 2

Specifications of Coatings.

| Enamel coating | BL | #1 | #2 | #3 | #4 | #5 | #6 | #7 |
|---|---|---|---|---|---|---|---|---|
| Additive material | N/A | $TiO_2$ | $TiO_2$ | $WS_2$ | $TiO_2$ | $TiO_2$ | $TiO_2$ | $TiO_2$ |
| Additive particle size | N/A | −325 mesh (<45 μm) | 0.9-1.6 μm | — | −100 mesh (<145 μm) | −140, +325 mesh (45-105 μm) | 30-40 nm | 10 × 40 nm |
| Coat. Thick. (μm) | 173 | 241 | 213 | 337 | 143 | 185 | 173 | 213 |

Vickers microindentation was conducted under a 200 g-g load to measure the hardness of coatings.

Figure 11:
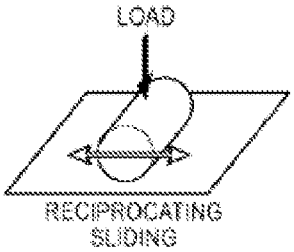
FIG. 11 is a schematic drawing of the friction and wear testing apparatus used to collect the friction and wear data shown in FIGS. 13A, 13B, 14A and 14B.

Friction and wear tests were conducted on those racks by rubbing against a baseline oven liner using cylinder-on-flat reciprocating sliding test configuration, as schematically illustrated in FIG. 11, on a Plint TE-77 tribo-tester. Cylinders were cut off oven rack rims with a length of 20 mm. Flats were cut off from a baseline oven liner in the size of 25.4×25.4 mm. Sliding stroke was 10 mm and oscillation frequency was 5 Hz. All coatings were tested at 400° F. (204° C.). Two sets of tests were conducted:

Test Set I: 50 N load and 1000 cycles. The 50 N load was used to generate a nominal initial contact stress of 194 MPa, similar to that for rack-on-liner in oven under 40 lbs load (see FIGS. 13A and 13B).

Test Set II: 13 N load and 600 cycles. The 13 N load produced a nominal initial contact stress of 98 MPa, similar to that for the rack-on-liner in oven under 10 lbs load (See FIGS. 14A and 14B).

The results for Test set I are shown in FIGS. 13A and 13B.

The results for Test set II are shown in FIGS. 14A and 14B.

The #1, #2, and #6 racks had about 35% wear reduction compared with the baseline.

Test Set I (50 N, 1000 cycles)

It was observed that the friction behavior of all coatings was in a similar pattern during the test: started relatively high followed by a gradual decrease but then climbed up to a higher level. The turnaround point was when the rack coating wore through and the substrate metal started in contact. Most coatings wore through during the 1000-cycle test. The coating survival time depended on both the coating thickness and wear-resistance. Based on the wear scar measurement, the calculated coating thickness varied significantly, from 173 to 337 as listed in Table 2.

Friction and wear results of the baseline and seven modified enamel coatings are show in FIGS. 13A and 13B. Initial friction coefficient for all the coatings was in a narrow band of 0.7-0.75. The steady-state friction coefficient, captured right before coating wear-through, varied in a larger range, 0.51-0.66. The #1 and #6 racks produced lower friction than the baseline by 15%.

The wear volumes of the coatings were calculated by wear scar measurement. Results are shown in FIG. 13B. All modified coatings had lower wear rates than the baseline to some extent.

Test Set II (13 N, 600 cycles)

In test set II, the $TiO_2$ modified coatings were benchmarked against both dry and oiled baselines. The $WS_2$ modified coating (#3) was ruled out due to its porosity and unsatisfactory performance in test set I. With a lower load 13 N applied in test set II, all coatings survived without wearing through. Friction and wear results are summarized in FIGS. 14A and 14B. Some observations are made below:

The oiled base (baseline) showed very little improvement over the dry one, with slightly lower friction and comparable wear.

The #1, #2, and #6 coatings had the lowest steady-state friction coefficient, about 15% and 10% lower than the dry and oiled baseline, respectively (FIG. 14A).

The #1, #2, and #6 coatings also had the lowest wear rates, about 35-45% lower than the dry and oiled baselines (FIG. 14B).

All $TiO_2$ modified coatings produced less wear on the liner compared with the baselines. The #5 coating removed the least material from the liner, but suffered high wear on itself.

Results have suggested significant effects of the $TiO_2$ particle size and shape on the friction and wear behavior. As plotted in FIG. 15, a threshold particle size seems to exist between 45 μm and 105 μm where the friction and wear transitioned from a lower level to a higher level. When particles are smaller than 45 μm, the coatings (#1, #2, and #6) performed much better than the baseline; while when the particles are larger than 105 μm, the coatings (#4 and #5) did not show much improvement. There was an exception, #7, that used nano-sized particles but did not work well, probably because of the needle shape particles (aspect ratio 4:1). Results suggest that small-sized (<45 μm) and low-aspect-ratio (less than 2:1, preferably 1:1, e.g. spherical) particles are preferred.

It is to be understood, however, that even though numerous characteristics and advantages of the various embodiments of the present invention have been set forth in the foregoing description, together with details of the structure and function of the various embodiments of the present invention as shown in the attached drawings, this disclosure is illustrative only and changes may be made in detail, especially in manners of shape, size and arrangement of the parts, within the principles of the present invention, to the full extent indicated by the broad general meaning of the terms in which the appended claims are expressed.

What is claimed is:

1. A lubricious glass-coated metal cooking article capable of withstanding repeated heating and cooling between room temperature and at least 500° F. without chipping or cracking the glass coating, wherein:

the glass coating includes about 0.1 to about 20% by weight of a homogeneously distributed dry refractory lubricant material, the dry refractory lubricant material consists of particles having a particle size less than 45 μm and an aspect ratio of less than 2:1, and the dry refractory lubricant material is selected from the group consisting of carbon; graphite; boron nitride; cubic boron nitride; molybdenum (IV) sulfide; molybdenum sulfide; molybdenum (IV) selenide; molybdenum selenide, tungsten (IV) sulfide; tungsten disulfide; tungsten sulfide; silicon nitride ($Si_3N_4$); TiN; TiC; TiCN; $TiO_2$; TiAlN; CrN; SiC; diamond-like carbon; tungsten carbide (WC); zirconium oxide ($ZrO_2$); zirconium oxide and 0.1 to 40 weight % aluminum oxide; alumina-zirconia; antimony; antimony oxide; antimony trioxide; and mixtures thereof.

2. The lubricious glass-coated, metal article of claim 1, wherein the metal is drawn steel rod and the amount of carbon and the degree of diameter reduction of the steel rod are selected to provide sufficient cavities in the drawn steel such that the glass coating does not chip or crack when the glass-coated article is heated to a temperature above 900° F.

3. The lubricious glass-coated, drawn steel rod article of claim 2, wherein the glass coating is a porcelain material applied in a thickness is the range of 1 to 20 mils.

4. The lubricious glass-coated, drawn steel rod article of claim 3, wherein the glass coating is a porcelain material applied in a thickness is the range of 4 to 10 mils.

5. The lubricious glass-coated, metal article of claim 1, wherein the article is a cooking surface selected from an oven rack, oven ladder rack, burner grate, and a barbeque grill rack.

6. The lubricious glass-coated, drawn steel article of claim 3, wherein the glass coating is a porcelain enamel material.

7. The lubricious glass-coated, drawn steel article of claim 6, wherein the porcelain is applied in multiple coating steps.

8. The lubricious glass-coated, metal article of claim 1, wherein the metal is a metal rod drawn to reduce the diameter at least about 20%.

9. The lubricious glass-coated, metal article of claim 8, wherein the metal is a metal rod drawn to reduce the diameter at least about 30%.

10. The lubricious glass-coated, metal article of claim 9, wherein the metal rod is drawn to reduce the diameter at least about 40%.

11. The lubricious glass-coated, metal article of claim 10, wherein the metal rod is drawn to reduce the diameter at least about 45%.

12. The lubricious glass-coated, metal article of claim 11, wherein the metal rod is drawn to reduce the diameter at least about 50%.

13. The lubricious glass-coated, metal article of claim 1, wherein the metal is a steel rod drawn through cold dies to gradually reduce the rod diameter.

14. The lubricious glass-coated, metal article of claim 1, wherein the metal is steel rod drawn in a cold die to provide sufficient cavities in the metal for receiving hydrogen emitted from the metal such that the glass coating is not damaged by the emitted hydrogen when the article is heated to a temperature above 900° F.

15. The lubricious glass-coated, metal article of claim 1, wherein the dry refractory lubricant material is present in the glass coating in an amount of about 0.5% to about 10% by weight of the glass coating.

16. The lubricious glass-coated, metal article of claim 15, wherein the dry refractory lubricant material is present in the glass coating in an amount of about 2% to about 5% by weight of the glass coating.

17. The lubricious glass-coated, metal article of claim 16, wherein the dry refractory lubricant material is present in the glass coating in an amount of about 2% to about 3% by weight of the glass coating.

18. The lubricious glass-coated, metal article of claim 1, wherein the dry refractory lubricant material has an aspect ratio of about 1:1.

19. A lubricious glass-coated steel article, said article capable of withstanding a hydrogen-emitting temperature sufficient to emit hydrogen gas from the steel such that hydrogen gas emitted from the steel is contained within cavities formed in the steel during drawing, without escaping through the glass coating, such that the glass coating does not chip or crack at said hydrogen-emitting temperature, wherein the steel rod is drawn to reduce the diameter of the steel rod at least 20%, and the steel comprises the following components by weight:

Iron: about 80% to about 99.9%;

Carbon: up to about 0.08%; and

A transition metal selected from Vn, Ta, Ti, Ni or mixture of any two or more: 0.001% to about 0.2%, wherein the amount of carbon in the steel rod material, the amount of carbon stabilizing transition metal in the steel rod material and the degree to which the diameter of the cross-sectional area of the steel rod material is reduced, when the steel wire is drawn from the steel rod material, are selected to prevent chipping of the glass material away from the outer surface of the article due to the release of hydrogen gas from the steel wire members when the glass-coated steel wire members are heated to a temperature above 900° F.; and wherein the glass surface includes a dry refractory lubricant material, and the dry refractory lubricant material consists of particles having a particle size less than 45 μm and an aspect ratio of less than 2:1.

20. The lubricious glass-coated, metal article of claim 19, wherein the dry refractory lubricant material is present in the glass coating in an amount of about 0.5% to about 10% by weight of the glass coating.

21. The lubricious glass-coated, metal article of claim 20, wherein the dry refractory lubricant material is present in the glass coating in an amount of about 2% to about 5% by weight of the glass coating.

22. The lubricious glass-coated, metal article of claim 21, wherein the dry refractory lubricant material is present in the glass coating in an amount of about 2% to about 3% by weight of the glass coating.

23. The lubricious glass-coated, metal article of claim 19, wherein the dry refractory lubricant material has an aspect ratio of about 1:1.

24. The lubricious glass coated, drawn steel rod article of claim 23, wherein the amounts of iron, carbon, and transition metal and the degree of diameter reduction of the steel rod are selected to provide sufficient cavities in the drawn steel such that the glass coating does not chip or crack when the glass-coated article is heated to a temperature above 900° F.

25. The lubricious glass-coated, drawn steel rod article of claim 24, wherein the glass coating is a porcelain material applied in a thickness is the range of 1 to 20 mils.

26. The lubricious glass-coated, drawn steel rod article of claim 25, wherein the glass coating is a porcelain material applied in a thickness is the range of 4 to 10 mils.

27. The lubricious glass-coated, drawn steel product of claim 23, wherein the article is a cooking surface selected from an oven rack, oven ladder rack, burner grate, and a barbeque grill rack.

28. The lubricious glass-coated, drawn steel article of claim 25, wherein the glass coating is a porcelain enamel material.

29. The lubricious glass-coated, drawn steel article of claim 28, wherein the porcelain enamel material is applied in multiple coating steps.

30. The lubricious glass-coated, drawn steel article of claim 23, wherein the steel rod is drawn to reduce the diameter of the steel rod at least about 30%.

31. The lubricious glass-coated, drawn steel article of claim 30, wherein the steel rod is drawn to reduce the diameter of the steel rod at least about 50%.

32. The lubricious glass-coated, drawn steel article of claim 30, wherein the steel rod is drawn through cold dies to gradually reduce the rod diameter.

33. The lubricious glass-coated, metal article of claim 19, wherein the dry refractory lubricant material is present in the glass coating in an amount of about 0.5% to about 10% by weight of the glass coating.

34. The lubricious glass-coated, metal article of claim 33, wherein the dry refractory lubricant material is present in the glass coating in an amount of about 2% to about 5% by weight of the glass coating.

35. The lubricious glass-coated, metal article of claim 34, wherein the dry refractory lubricant material is present in the glass coating in an amount of about 2% to about 3% by weight of the glass coating.

36. The lubricious, glass-coated drawn steel article of claim 15, wherein the dry refractory lubricant material has a particle size less than about 45 μm and is selected from the group consisting of consisting of carbon; graphite; boron nitride; cubic boron nitride; molybdenum (IV) sulfide; molybdenum disulfide; molybdenum sulfide; molybdenum (IV) selenide; molybdenum selenide; tungsten (IV) sulfide; tungsten disulfide; tungsten sulfide; silicon nitride ($Si_3N_4$); TiN; TiC; TiCN; $TiO_2$; TiAlN; CrN; SiC; diamond-like carbon; tungsten carbide (WC); zirconium oxide ($ZrO_2$); zirconium oxide and 0.1 to 40 weight % aluminum oxide; alumina-zirconia; antimony; antimony oxide; antimony trioxide; and mixtures thereof.

37. The lubricious glass-coated, metal article of claim 36, wherein the dry refractory lubricant material is present in the glass coating in an amount of about 2% to about 5% by weight of the glass coating.

38. The lubricious glass-coated, metal article of claim 37 wherein the dry refractory lubricant material is present in the glass coating in an amount of about 2% to about 3% by weight of the glass coating.

39. The lubricious glass-coated, metal article of claim 36, wherein the dry refractory lubricant material has an aspect ratio of about 1:1.

40. A lubricious glass-coated steel wire oven rack comprising:

a plurality of elongated steel wire members joined together to form an oven rack having an outer surface;

the plurality of elongated steel wire members being made from a steel rod material containing up to about 0.08% by weight carbon;

the plurality of elongated steel wire members being made from the steel rod material by drawing the steel rod material to form steel wire;

wherein the diameter of the cross-sectional area of the steel rod material is reduced by at least about 20% when the steel rod material is drawn to form the steel wire;

the outer surface of the oven rack being coated by a dry lubricious glass material containing a dry refractory lubricant, the dry refractory lubricant consisting of particles having a particle size less than 45 μm and an aspect ratio of less than 2:1;

wherein the amount of carbon in the steel rod material and the degree to which the diameter of the cross-sectional area of the steel rod material is reduced, when the steel wire is drawn from the steel rod material, are selected to prevent chipping of the glass material away from the outer surface of the article due to the release of hydrogen gas from the steel wire members when the glass-coated steel wire members are heated to a temperature above 900° F.

41. The lubricious glass-coated steel wire oven rack of claim 40, wherein the glass material is porcelain coated onto the outer surface of the steel wire members by first applying a base coat and thereafter applying a lubricious top coat containing 0.1% to about 20% by weight of the dry lubricant material homogenously dispersed in the lubricious top coat, wherein the dry lubricant material is selected from the group consisting of carbon; graphite; boron nitride; cubic boron nitride; molybdenum (IV) sulfide; molybdenum disulfide; molybdenum sulfide; molybdenum (IV) selenide; molybdenum selenide; tungsten (IV) sulfide; tungsten disulfide; tungsten sulfide; silicon nitride ($Si_3N_4$); TiN; TiC; TiCN; $TiO_2$; TiAlN; CrN; SiC; diamond-like carbon; tungsten carbide (WC); zirconium oxide ($ZrO_2$); zirconium oxide and 0.1 to 40 weight % aluminum oxide; alumina-zirconia; antimony; antimony oxide; antimony trioxide; and mixtures thereof.

42. The lubricious glass-coated steel wire oven rack of claim 40, wherein the coating thickness is in the range of 4 to 10 mils and the dry refractory lubricant comprises about 1 to about 10 percent by weight of the coating composition that contains the dry lubricant.

43. The lubricious glass-coated steel wire oven rack of claim 40, wherein the lubricious glass material coating includes two separate applied coatings in which a first ground coat of powdered glass is applied and then a second top coat of lubricious powdered glass containing the dry lubricant is applied in a subsequent coating application.

44. The lubricious glass-coated steel wire oven rack of claim 43, wherein the two applied glass coatings are electrostatically applied.

45. A method of making a lubricious glass-coated steel wire oven rack, comprising the steps of:

a) providing steel rod material containing from about 80 to about 99.9% by weight of iron, up to about 0.08% by weight of carbon and from about 0.001 to about 0.2% by weight of carbon stabilizing transition metal selected from the group consisting of Vanadium, Tantalum, Titanium and Niobium;

b) drawing the steel rod material to form steel wire, wherein the diameter of the cross-sectional area of the steel rod material is reduced by at least about 20%;

c) forming a plurality of elongated steel wire members from said steel wire;

d) joining the plurality of steel wire members to one another to form interconnected parts of a steel wire oven rack; and e) coating the steel wire oven rack with a lubricious porcelain containing about 1% to about 10% by weight of a dry refractory lubricant, the dry refractory lubricant consisting of particles having a particle size less than 45 μm and an aspect ratio of 2:1;

wherein the amount of carbon in the steel rod material, the amount of carbon stabilizing transition metal in the steel rod material and the degree to which the diameter of the cross-sectional area of the steel rod material is reduced, when the steel wire is drawn from the steel rod material, are selected to prevent chipping or spalling of the glass material away from the outer surface of the article due to the release of hydrogen gas from the steel wire members when the glass-coated steel wire members are heated to a temperature above 900° F.

46. The method of claim 45, wherein the lubricious porcelain is coated onto the steel wire oven rack in a wet coating process selected from the group consisting of electrostatic dry powder spray, wet spray, electrostatic wet spray, wet flow coating, wet dip, electro-phoretic deposition, and a combination thereof, followed by heating to a temperature of about 1500° F. to about 1600° F. or higher.

47. The method of claim 45, wherein the lubricious porcelain is coated onto the steel wire oven rack by an immersion or flow coating method selected from the group consisting of hand dipping, tong dipping, automatic dip machine coating, electrophoretic deposition, flow coating, and a combination thereof, followed by heating to a temperature of about 1550° F. or higher.

48. The method of claim 46, wherein the lubricious porcelain coated steel wire oven rack is heated to about 1500° F. to about 1600° F. for about 25 minutes prior to cooling.

49. The method of claim 45, wherein the steel rod is drawn through cold dies to gradually reduce the diameter of the steel rod at least about 20%.

50. The method of claim 45, wherein the coated lubricious porcelain comprises porcelain enamel including a dry lubricant having a particle size less than about 45 μm and an aspect ratio less than 2:1, selected from the group consisting of carbon; graphite; boron nitride; cubic boron nitride; molybdenum (IV) sulfide; molybdenum disulfide; molybdenum sulfide; molybdenum (IV) selenide; molybdenum selenide; tungsten (IV) sulfide; tungsten disulfide; tungsten sulfide; silicon nitride ($Si_3N_4$); TiN; TiC; TiCN; $TiO_2$; TiAlN; CrN; SiC; diamond-like carbon; tungsten carbide (WC); zirconium oxide ($ZrO_2$); zirconium oxide and 0.1 to 40 weight % aluminum oxide; alumina-zirconia; antimony; antimony oxide; antimony trioxide; and mixtures thereof.

51. The method of claims 50 wherein the porcelain enamel and dry lubricant portion of the porcelain enamel are one of milled together and mixed, wherein the porcelain enamel has a particle size in the range of about 5 μm to about 200 μm.

52. The method of claim 51, wherein the porcelain enamel has a particle size in the range of about 10 μm to less than about 45 μm.

53. A method of cleaning a porcelain-coated steel wire oven rack capable of withstanding oven cleaning temperatures above 900° F. without porcelain chipping or cracking, comprising the steps of:

heating the oven to a temperature above 900° F., said oven containing said porcelain-coated steel wire oven rack formed by steps a)-e):

a) providing steel rod material containing from about 80 to about 99.9% by weight of iron, up to about 0.08% by weight of carbon and from about 0.001 to about 0.2% by weight of carbon stabilizing transition metal selected from the group consisting of Vanadium, Tantalum, Titanium and Niobium;

b) drawing the steel rod material to form steel wire, wherein the diameter of the cross-sectional area of the steel rod material is reduced by at least about 20% to form cavities in the steel wire in which hydrogen, emitted from the steel wire, is received and compressed at the oven cleaning temperature, without chipping or cracking the porcelain coating;

c) forming a plurality of elongated steel wire members from said steel wire;

d) joining the plurality of steel wire members to one another to form interconnected parts of a steel wire oven rack; and e) coating the steel wire oven rack with a lubricious porcelain containing a dry refractory lubricant material, the dry refractory lubricant material consisting of particles having a particle size less than 45 μm and an aspect ratio of less than 2:1, wherein the amount of carbon in the steel rod material, the amount of carbon stabilizing transition metal in the steel rod material and the degree to which the diameter of the cross-sectional area of the steel rod material is reduced, when the steel wire is drawn from the steel rod material, are selected to prevent chipping of the glass material away from the outer surface of the article due to the release of hydrogen gas from the steel wire members when the glass-coated steel wire members are heated to a temperature above 900° F.

54. The method of claim 53, wherein the lubricious porcelain coating includes about 1% to about 10% of a homogeneously distributed dry refractory lubricant material having a particle size in the range of about 20 nm to less than 45 μm selected from the group consisting of carbon; graphite; boron nitride; cubic boron nitride; molybdenum (IV) sulfide; molybdenum disulfide; molybdenum sulfide; molybdenum (IV) selenide; molybdenum selenide; tungsten (IV) sulfide; tungsten disulfide; tungsten sulfide; silicon nitride ($Si_3N_4$); TiN; TiC; TiCN; $TiO_2$; TiAlN; CrN; SiC; diamond-like carbon; tungsten carbide (WC); zirconium oxide ($ZrO_2$); zirconium oxide and 0.1 to 40 weight % aluminum oxide; alumina-zirconia; antimony; antimony oxide; antimony trioxide; and mixtures thereof.

55. The lubricious, glass-coated metal article of claim 1, wherein the dry refractory lubricant material is $TiO_2$.

56. The lubricious, glass-coated steel article of claim 19, wherein the dry refractory lubricant material is $TiO_2$.

57. The lubricious, glass-coated steel oven rack of claim 40, wherein the dry refractory lubricant material is $TiO_2$.

58. The method of claim 45, wherein the dry refractory lubricant material is $TiO_2$.

59. The method of claim 53, wherein the dry refractory lubricant material is $TiO_2$.

* * * * *

UNITED STATES PATENT AND TRADEMARK OFFICE

CERTIFICATE OF CORRECTION

PATENT NO. : 8,739,773 B2
APPLICATION NO. : 12/301718
DATED : June 3, 2014
INVENTOR(S) : Ambrose et al.

It is certified that error appears in the above-identified patent and that said Letters Patent is hereby corrected as shown below:

On the Title Page:

Item (57), line 9, "molybdenum (FV)" should be -- molybdenum (IV) --.

In the Claims:

At Column 15, line 62, "group consisting of" should be -- group --.

Signed and Sealed this
Twenty-third Day of June, 2015

Michelle K. Lee

Michelle K. Lee
*Director of the United States Patent and Trademark Office*